US009939775B2

(12) United States Patent
Mizutani

(10) Patent No.: US 9,939,775 B2
(45) Date of Patent: Apr. 10, 2018

(54) IMAGE FORMING APPARATUS WITH SEPARATOR TO SEPARATE A ROLLER FROM A PHOTOSENSITIVE DRUM

(71) Applicant: Brother Kogyo Kabushiki Kaisha, Nagoya-shi, Aichi-ken (JP)

(72) Inventor: Hiromitsu Mizutani, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/444,535

(22) Filed: Feb. 28, 2017

(65) Prior Publication Data

US 2017/0248908 A1 Aug. 31, 2017

(30) Foreign Application Priority Data

Feb. 29, 2016 (JP) ..... 2016-037647

(51) Int. Cl.
*G03G 15/04* (2006.01)
*G03G 21/16* (2006.01)

(52) U.S. Cl.
CPC ..... *G03G 21/1647* (2013.01); *G03G 21/1676* (2013.01)

(58) Field of Classification Search
CPC ..... G03G 21/1647; G03G 21/1676
USPC ..... 399/110, 111, 119
See application file for complete search history.

(56) References Cited

U.S. PATENT DOCUMENTS

| | | | | |
|---|---|---|---|---|
| 8,099,018 | B2 * | 1/2012 | Takakuwa et al. | G03G 21/1647 399/111 |
| 8,260,171 | B2 | 9/2012 | Matsuda | |
| 8,346,126 | B2 | 1/2013 | Okabe | |
| 8,565,642 | B2 | 10/2013 | Matsuda | |
| 8,831,473 | B2 | 9/2014 | Hashimoto et al. | |
| 9,588,484 | B2 * | 3/2017 | Sato | G03G 21/1676 |
| 2010/0080624 | A1 | 4/2010 | Matsuda | |
| 2010/0135694 | A1 | 6/2010 | Hashimoto et al. | |
| 2010/0166453 | A1 | 7/2010 | Okabe | |

(Continued)

FOREIGN PATENT DOCUMENTS

| | | |
|---|---|---|
| JP | 2010-102297 A | 5/2010 |
| JP | 2010-128342 A | 6/2010 |
| JP | 2010-151952 A | 7/2010 |

(Continued)

*Primary Examiner* — William J Royer
(74) *Attorney, Agent, or Firm* — Banner & Witcoff, Ltd.

(57) ABSTRACT

An image forming apparatus, including a photosensitive drum, a developer cartridge with a developer roller and a protrusion, a casing, a separator member to move the developer cartridge between a contact position and a separate position, and a first guide to guide the protrusion, is provided. The first guide confronts the protrusion along a direction orthogonal to an axial direction of the developer roller when the developer cartridge is in the contact position. The first guide includes a first guiding surface and a first inclined surface. The first guiding surface extends in parallel with a line connecting a center of a rotation axis of the developer roller with a center of a rotation axis of the photosensitive drum. The first inclined surface inclines with respect to the first guiding surface. The protrusion contacts the first inclined surface when the separator member moves the developer cartridge toward the separate position.

13 Claims, 10 Drawing Sheets

(56) References Cited

U.S. PATENT DOCUMENTS

2012/0288303 A1 11/2012 Matsuda

FOREIGN PATENT DOCUMENTS

| | | | |
|---|---|---|---|
| JP | 2010-156790 | A | 7/2010 |
| JP | 2010-186203 | A | 8/2010 |

* cited by examiner

UP
DOWN
REAR
FRONT

IMAGE FORMING APPARATUS WITH SEPARATOR TO SEPARATE A ROLLER FROM A PHOTOSENSITIVE DRUM

CROSS REFERENCE TO RELATED APPLICATION

This application claims priority from Japanese Patent Application No. 2016-037647 filed on Feb. 29, 2016, the entire subject matter of which is incorporated herein by reference.

BACKGROUND

Technical Field

An aspect of the present disclosure is related to an image forming apparatus having a separator device to separate a developer roller in a developer cartridge from a photosensitive drum.

Related Art

An image forming apparatus having a separator device configured to separate a developer roller in a developer cartridge from a photosensitive drum is known. In the image forming apparatus, a separating action, in which the developer roller is moved to be separated from the photosensitive drum, may be conducted. In the separating action, the developer roller may be moved in a direction along a line that connects a center of a rotation axis of the photosensitive drum with a center of a rotation axis of the developer roller.

SUMMARY

In order to conduct the separating action, a substantial amount of space may be required in the image forming apparatus so that the developer cartridge may be moved without interfering with other parts, items, or a beam that is emitted at the photosensitive drum. However, in order to secure the substantial amount of space inside, a volume of the image forming apparatus may increase.

The present disclosure is advantageous in that an image forming apparatus, which may be downsized by reducing a volume of the space for the separating action, is provided.

According to an aspect of the present invention, an image forming apparatus, including a photosensitive drum, a developer cartridge, a casing, a separator member, and a first guide, is provided. The developer cartridge includes a developer roller and a protrusion that protrudes in an axial direction of the developer roller. To the casing, the developer cartridge is attachable. The separator member is configured to move the developer cartridge between a contact position, in which the developer roller contacts the photosensitive drum, and a separate position, in which the developer roller is separated from the photosensitive drum. The first guide is arranged to confront the protrusion of the developer cartridge along an orthogonal direction orthogonal to the axial direction in a state where the developer cartridge is attached to the casing. The first guide includes a first guiding surface and a first inclined surface. The first guiding surface extends in parallel with a line that connects a center of a rotation axis of the developer roller with a center of a rotation axis of the photosensitive drum in a state where the developer roller is located in the contact position. The first inclined surface is located farther from the photosensitive drum than the first guiding surface and being continuous with the first guiding surface. The first inclined surface inclines with respect to the first guiding surface. The protrusion of the developer cartridge contacts the first inclined surface when the separator member moves the developer cartridge toward the separate position.

BRIEF DESCRIPTION OF THE ACCOMPANYING DRAWINGS

Figure 7A:
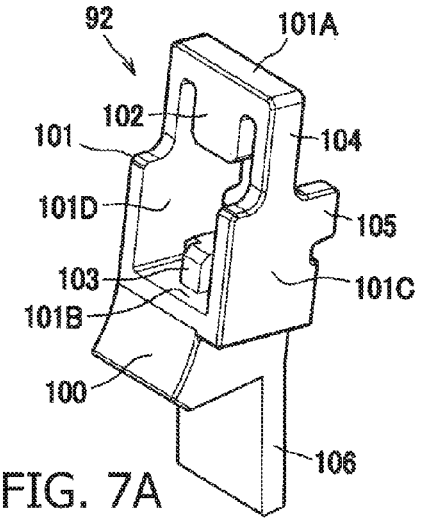
Figure 7B:
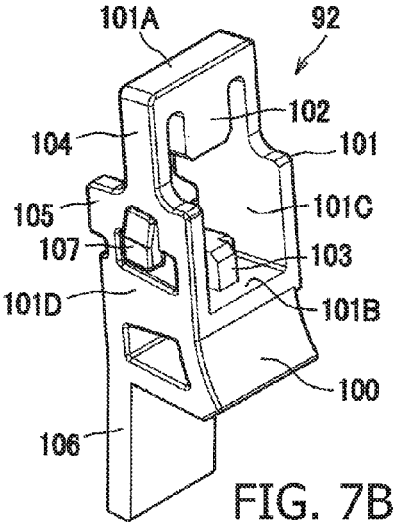
Figure 7C:
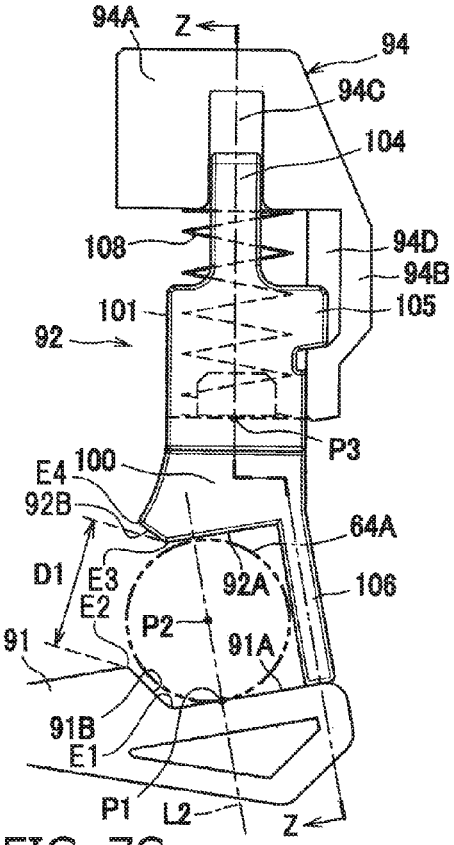
Figure 7D:
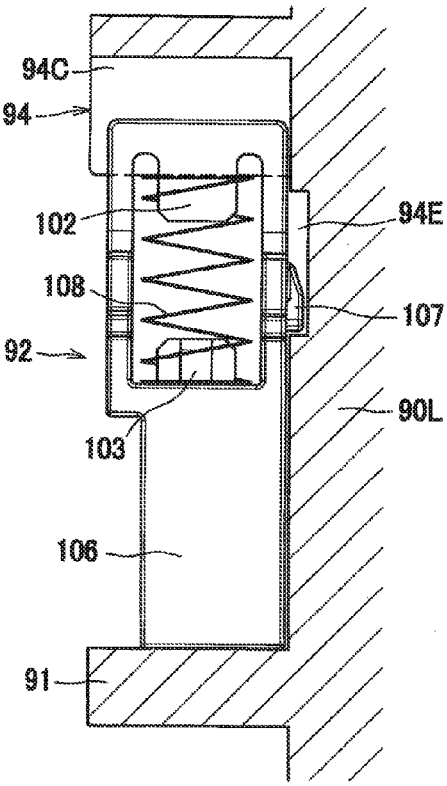

FIGS. 7A-7B are perspective views of a second guide in the laser printer according to the embodiment of the present disclosure. FIG. 7C is a lateral view of the second guide of the laser printer from the inner side according to the embodiment of the present disclosure. FIG. 7D is a cross-sectional view of the second guide according to the embodiment of the present disclosure viewed at a line Z-Z shown in FIG. 7C.

Figures 8A, 8B, 8C:
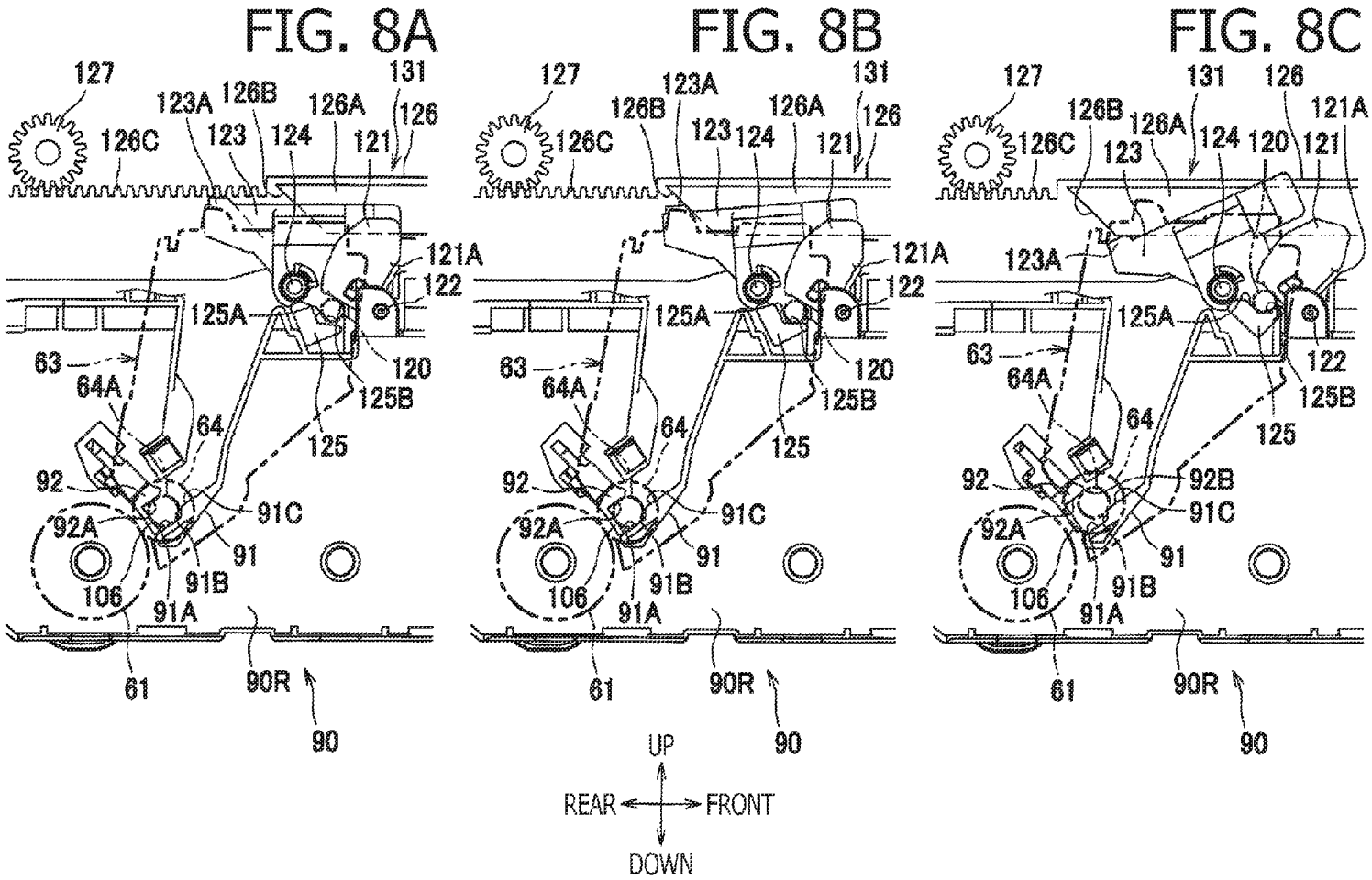

FIG. 8A illustrates a behavior of a separator device according to the embodiment of the present disclosure when a developer roller is located in a contact position. FIG. 8B illustrates a behavior of the separator device according to the embodiment of the present disclosure when a separator member contacts a boss. FIG. 8C illustrates a behavior of the separator device according to the embodiment of the present disclosure when the developer roller is located in a separate position.

Figure 9A:
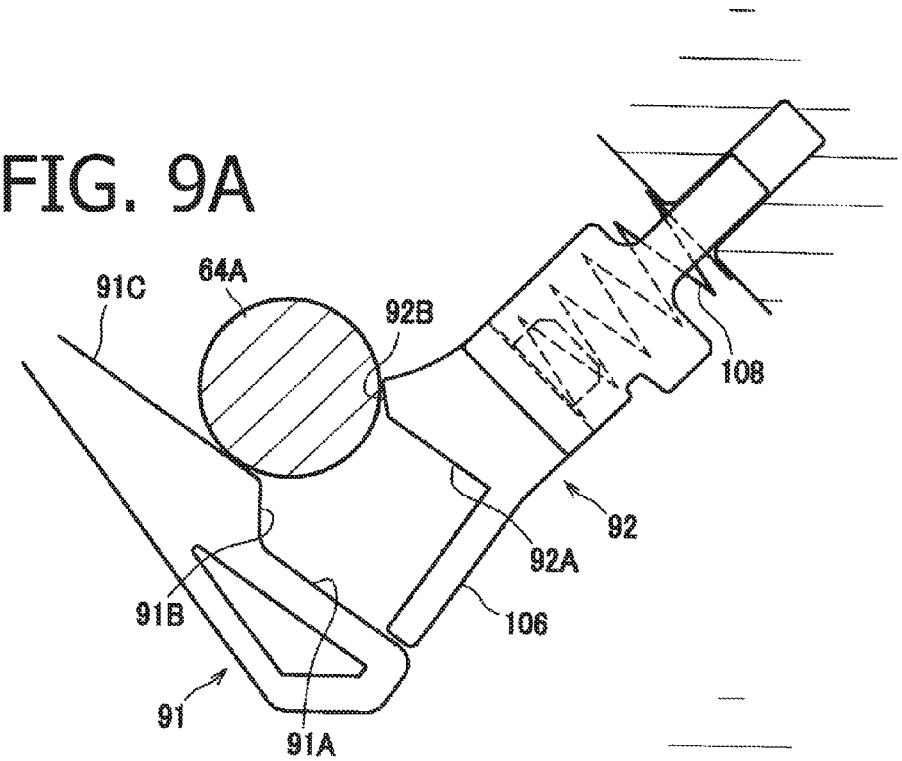
Figure 9B:
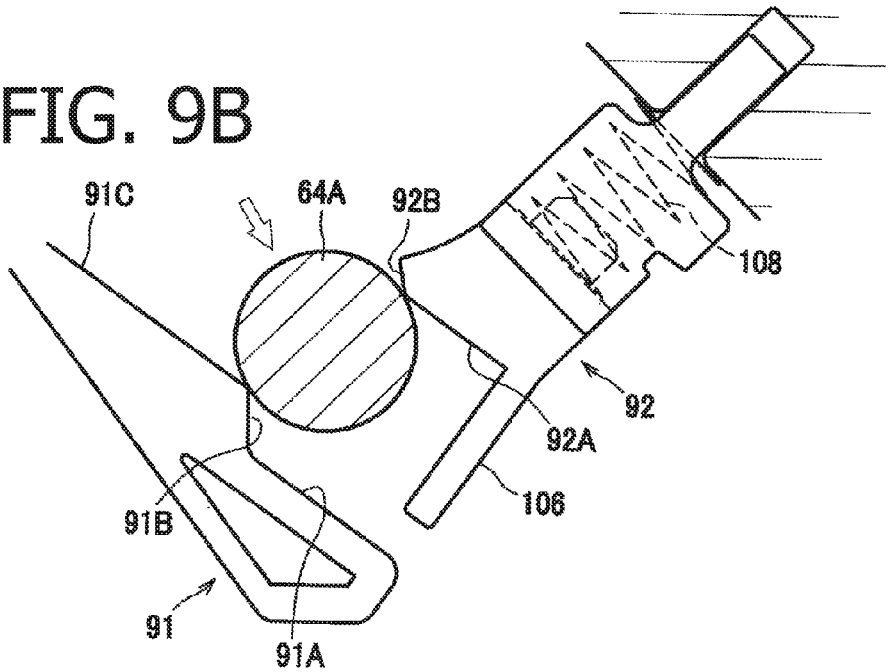

FIGS. 9A-9B illustrate behaviors of a collar moving in an intermediate position between the first guide and the second guide when the developer cartridge is being attached to the drum unit according to the embodiment of the present disclosure.

Figure 10:
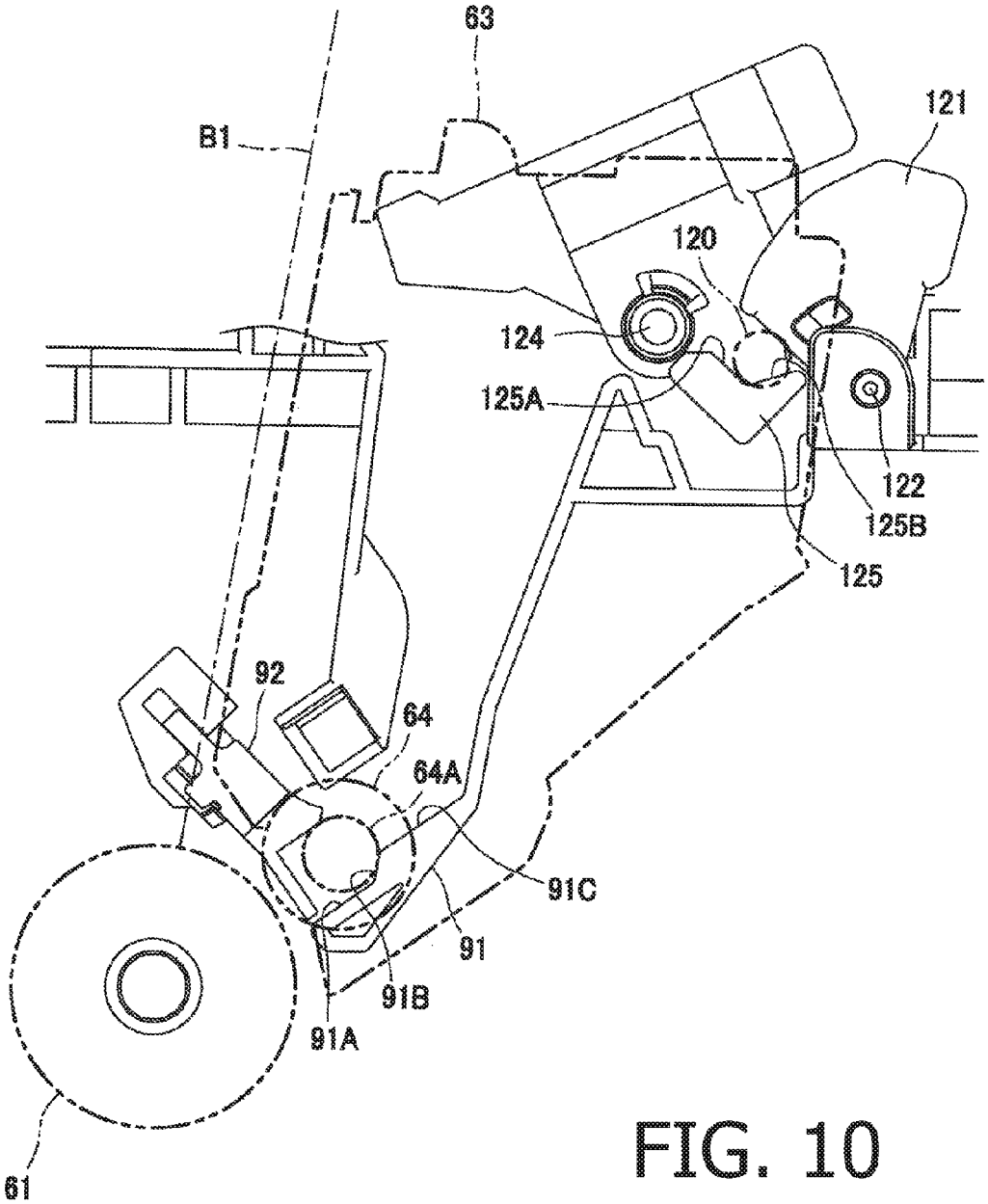

FIG. 10 illustrates a modified example when the developer roller is located in the separate position in the laser printer according to the embodiment of the present disclosure.

DETAILED DESCRIPTION

Figure 1:
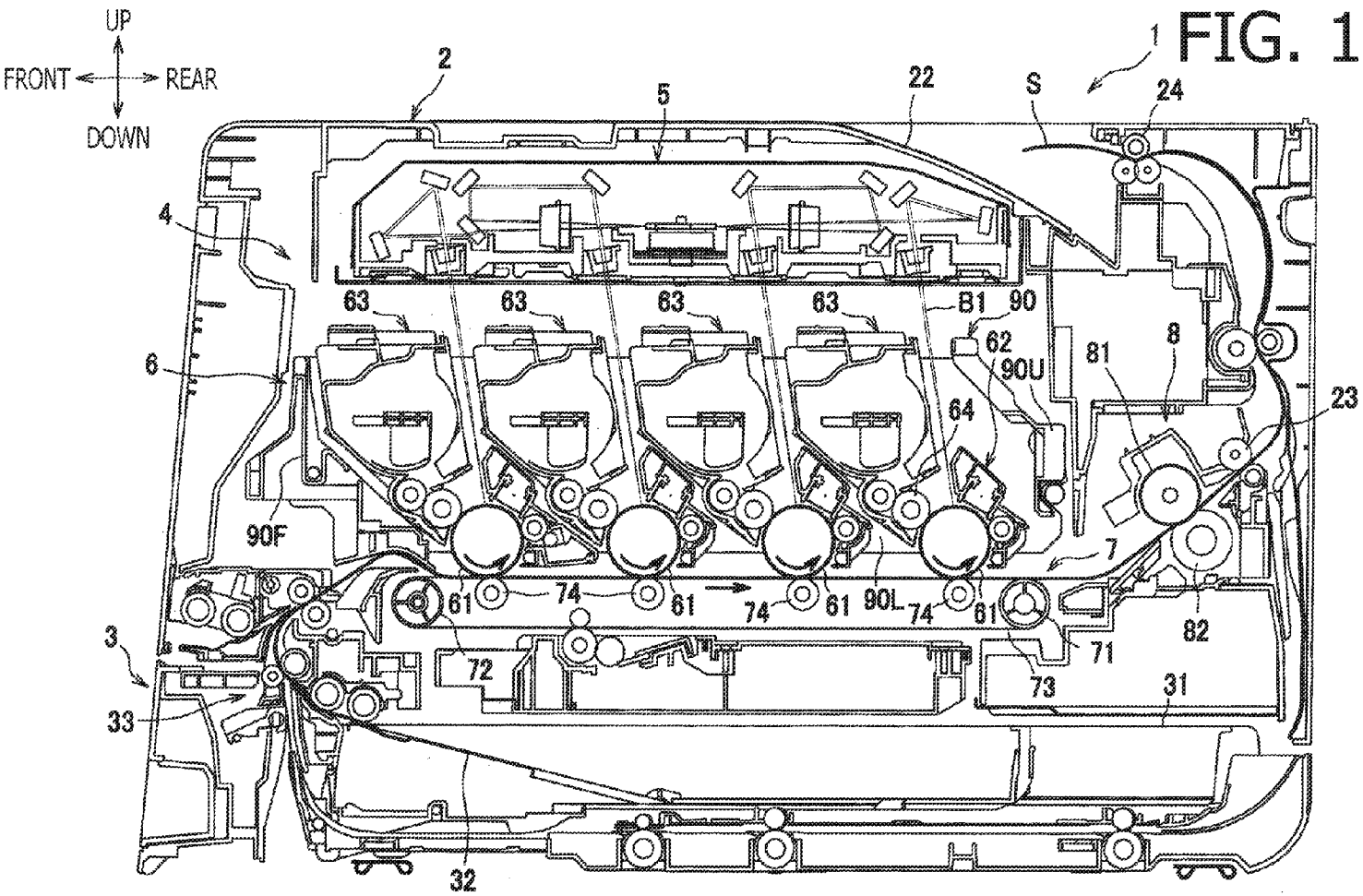
FIG. 1 is a cross-sectional side view of a laser printer according to an embodiment of the present disclosure.

Hereinafter, an exemplary configuration of a laser printer 1 according to an embodiment of the present invention will be described with reference to the accompanying drawings. In the following description, directions concerning the laser printer 1 will be referred to in accordance with orientation indicated by arrows in each drawing, i.e., based on a user's view point. For example, a viewer's left-hand side appearing in FIG. 1 is referred to as a front side of the laser printer 1 for the user, and a right-hand side in FIG. 1 opposite from the front side is referred to as a rear side for the user. A side which corresponds to the viewer's nearer side is referred to as a right-hand for the user, and an opposite side from the right, which corresponds to the viewer's farther side is referred to as a left-hand side for the user. An up-down direction in FIG. 1 corresponds to a vertical direction of the laser printer 1. Further, the right-to-left or left-to-right direction of the laser printer 1 may be referred to as a widthwise direction, and the front-to-rear or rear-to-front direction may be referred to as a direction of depth. The widthwise direction and the direction of depth are orthogonal to each other. Furthermore, directions of the drawings in FIGS. 2-10 are similarly based on the orientation of the laser printer 1 as defined above and correspond to those with respect to the laser printer 1 shown in FIG. 1 even when the figures are viewed from different viewpoints.

[Overall Configuration of the Image Forming Apparatus]

The laser printer 1 includes, as shown in FIG. 1, a feeder unit 3 and an image forming unit 4, which are arranged inside a body casing 2. The feeder unit 3 may feed sheets S to the image forming unit 4, and the image forming unit 4 may form an image on the sheet S being fed. The image forming unit 4 includes an exposure device 5, a drum unit 6, a transfer unit 7, and a fuser device 8.

The feeder unit 3 is arranged in a lower position in the body casing 2 and includes a feeder tray 31 to accommodate sheets S, a sheet-presser plate 32, and a feeder device 33. The sheets S in the feeder tray 31 may be uplifted by the sheet-presser plate 32 so that front ends of the sheets S are picked up by the feeder device 33 and separated one-by-one to be fed to the image forming unit 4.

The exposure device 5 is arranged in an upper position in the body casing 2 and is configured to emit laser beams B1 at photosensitive drums 61 to expose the photosensitive drums 61 to the laser beams B1.

The drum unit 6 is arranged between the feeder tray 31 and the exposure device 5 and includes a supporting member 90, a plurality of (e.g., four) photosensitive drums 61, and a plurality of (e.g., four) chargers 62. The photosensitive drums 61 are arranged to align in the front-rear direction, and the chargers 62 are each arranged in positions corresponding to the photosensitive drums 61. The supporting member 90 is in a form of a frame having a left-side lateral wall 90L and a right-side lateral wall 90R (see FIGS. 8A-8C), a front beam 90F, and a rear beam 90U. The left-side lateral wall 90L and the right-side lateral wall 90R are arranged to be distanced apart along the widthwise direction from each other. The front beam 90F connects front ends of the left-side lateral wall 90L and the right-side lateral wall 90R, and the rear beam 90U connects rear ends of the left-side lateral wall 90L and the right-side lateral wall 90R. To the drum unit 6, developer cartridges 63 are attachable. The developer cartridges 63 are each provided to correspond to one of the photosensitive drums 61 and are arranged to align in the front-rear direction. The developer cartridges 63 are arranged at positions, in which the developer cartridges should not interfere with the laser beams B1 emitted from the exposure device 5 at the photosensitive drum 61, to be spaced apart from one another for a small amount of intervening clearance so that a dimension of the drum unit 6 in the front-rear direction may not be increased.

The transfer unit 7 is disposed in a position between the feeder unit 31 and the drum unit 6. The transfer unit 7 includes a driving roller 71, a driven roller 72, a conveyer belt 73, and a plurality of (e.g., four) transfer rollers 74. The conveyer belt 473 may be an endless belt strained around the driving roller 71 and the driven roller 72. The conveyer belt 73 is arranged to have an upper outer surface thereof to be in contact with the photosensitive drums 61. On an inner side of the conveyer belt 73, arranged are transfer rollers 74, which nip the conveyer belt 73 in conjunction with the photosensitive drums 61.

The fuser device 8 is arranged in a rearward position with respect to the drum unit 6 and the transfer unit 7 and includes a heat roller 81 and a pressure roller 82. The pressure roller 82 is disposed in a position to confront the heat roller 81 and is urged against the heat roller 81.

In the image forming unit 4, during an image forming operation, surfaces of the photosensitive drums 61 are electrically charged by the corresponding chargers 62 evenly and exposed to the laser beams B1 emitted from the exposure device 5 so that electrical charges of the exposed areas are removed and latent images according to image data are formed to be carried on the surfaces of the photosensitive drums 61. Meanwhile, toner carried on developer rollers 64 are supplied to the latent images being carried on the photosensitive drums 61. Thus, the latent images are developed to form toner images and carried on the photosensitive drums 61. Thereafter, as the sheet S conveyed by the feeder unit 3 passes through positions between the photosensitive drums 61 and the conveyer belt 73 one after another, the toner images formed on the photosensitive drums 61 are transferred onto the sheet S in colored layers. As the sheet S with the transferred toner images is conveyed through an intermediate position between the heat roller 81 and the pressure roller 82, the toner images are thermally fixed on the sheet S. The sheet S with the thermally fixed toner images is ejected out of the body casing 2 by a conveyer roller 23 and an ejection roller 24 and placed on an ejection tray 22.

[Overall Configuration of the Drum Unit]

Figure 2:
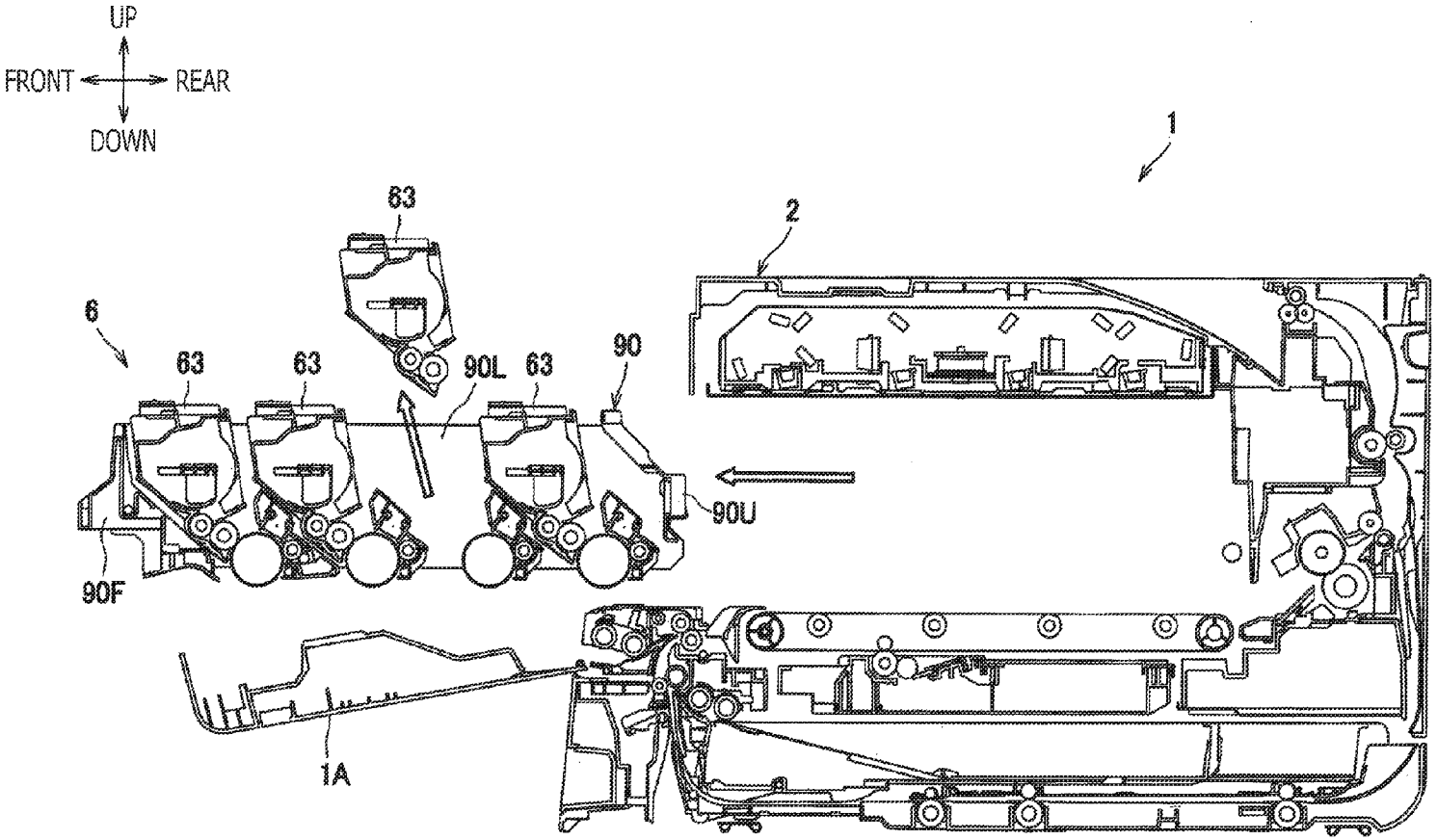
FIG. 2 is a cross-sectional side view of the laser printer with a developer cartridge drawn upward from a drum unit of the laser printer according to the embodiment of the present disclosure.

The body casing 2 includes a cover 1A, which is movable to open frontward, as shown in FIG. 2. The body casing 2 may form an aperture by opening the cover 1A so that the drum unit 6 may be movable to slide in the front-rear direction to be attached to or detached from the body casing 2. Meanwhile, the developer cartridges 63 may be attached to or detached from the supporting member 90 when the drum unit 6 is drawn outside the body casing 2. The developer cartridges 63 may be detached from the supporting member 90 by moving in a direction indicated by an arrow in the supporting member 90 in FIG. 2 and may be attached to the supporting member 90 by moving in a direction opposite from the direction indicated by the arrow. Therefore, in the following description, the direction opposite from the direction indicated by the arrow shown in the supporting member 90 in FIG. 2 may be called as an attaching direction. The supporting member 90 is an example of a casing.

Figure 3:
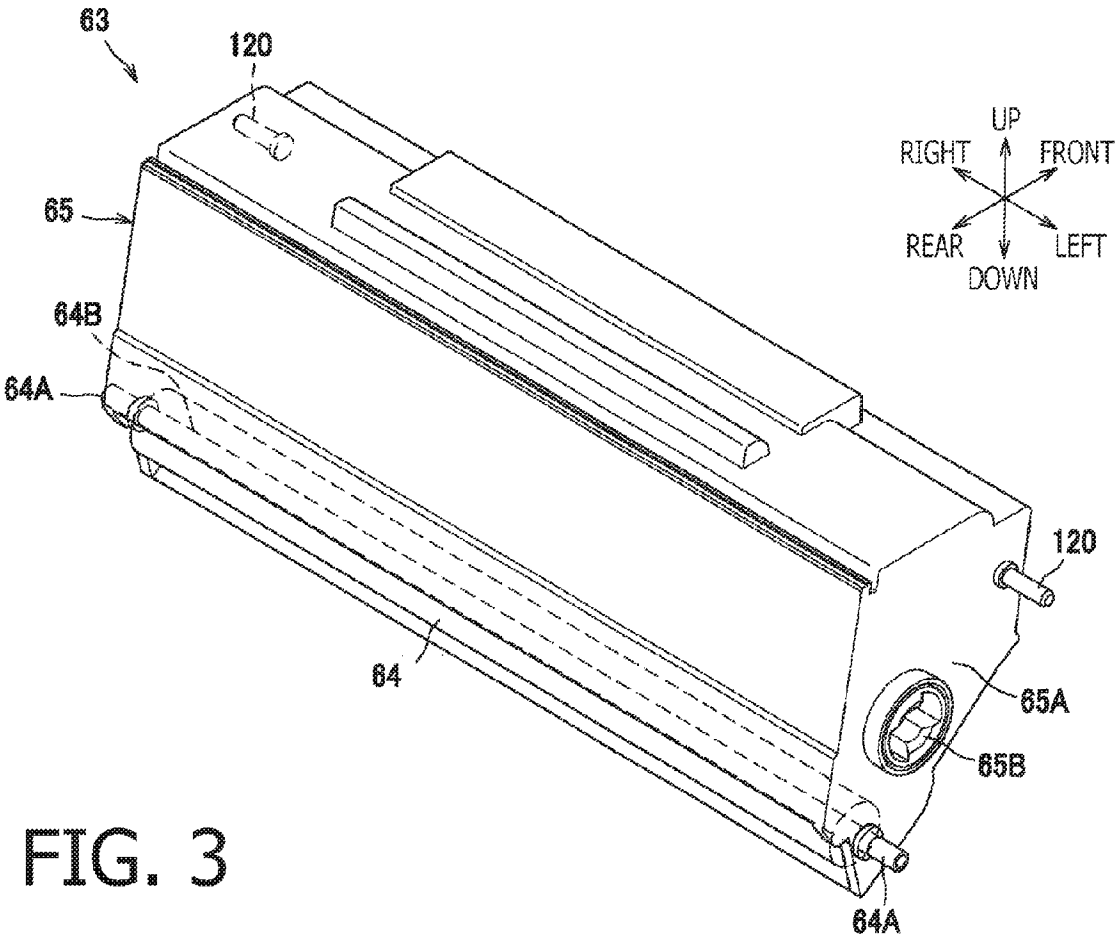
FIG. 3 is perspective view of the developer cartridge according to the embodiment of the present disclosure.

FIG. 3 shows a perspective view of one of the four developer cartridges 63. As shown in FIG. 3, the developer cartridge 63 includes a developer roller 64, which is rotatably supported by a cartridge case 65. The developer roller 64 includes a rotation shaft 64B axially extending in the widthwise direction. Axial ends of the rotation shaft 64B protrude rightward and leftward through paired lateral walls 65A of the cartridge case 65 on the right and left, respectively, and a collar 64A is fitted to each axial end of the rotation shaft 64B. In other words, the developer cartridge 63 includes the collars 64A, and the collars 64A are arranged to protrude in an axial direction of the rotation shaft 64B of the developer roller 64. The axial direction of the rotation shaft 64B of the developer roller 64 is equal to a direction of axis of the developer roller 64. Therefore, the collars 64A protrude in the axial direction of the developer roller 64. Meanwhile, on each of the paired lateral walls 65A, at an upper-frontward position, arranged is a boss 120 protruding outward in the widthwise direction. In other words, the boss 120 is arranged in a position on an upstream side with regard to the attaching direction on each lateral wall 65A.

On a leftward one of the lateral walls 65A of the developer cartridge 63, arranged is a coupling 65B. The coupling 65B is engageable with an input member (not shown), which may input a driving force to the developer roller 64. In other words, the coupling 65B may work as a driving force input device.

Figure 4A:
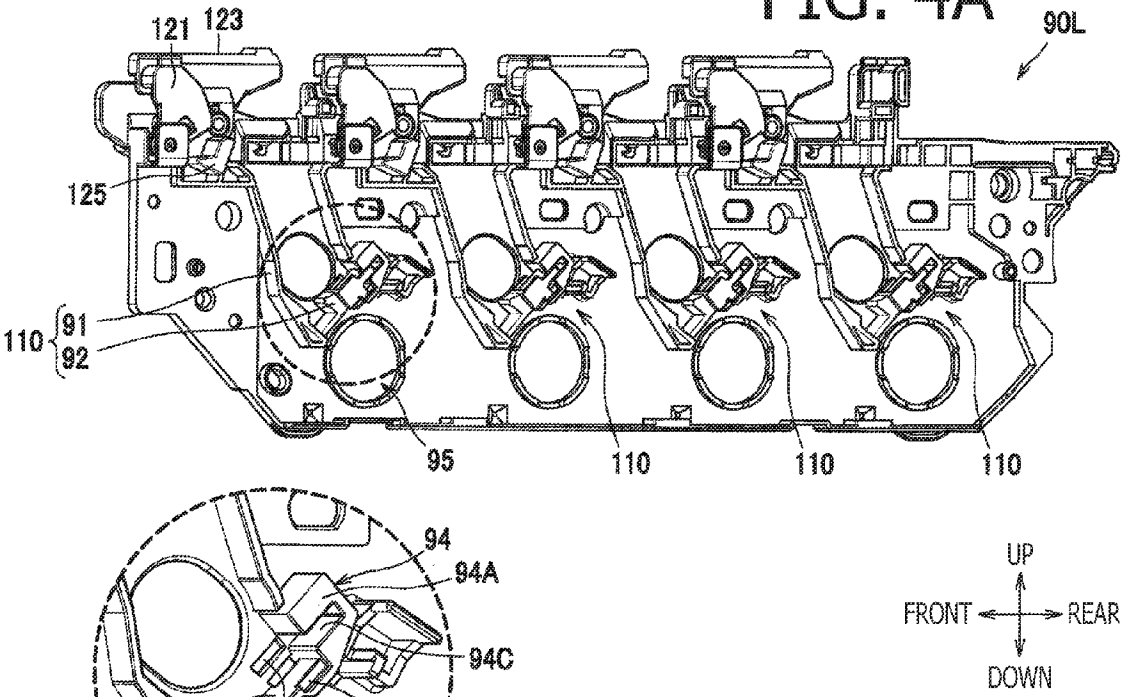
FIG. 4A is a perspective view of an inner side of a left-side lateral wall of the drum unit according to the embodiment of the present disclosure.

As shown in FIG. 4A, on an inner face of a left-side lateral wall 90L of the supporting member 90, arranged are four (4) cartridge guides 110 corresponding to the four developer cartridges 63. Each cartridge guide 110 includes a first guide 91 and a second guide 92 to guide the collar 64A in the developer cartridge 63 when the developer cartridge 63 is attached to or detached from the supporting member 90.

Figure 5:
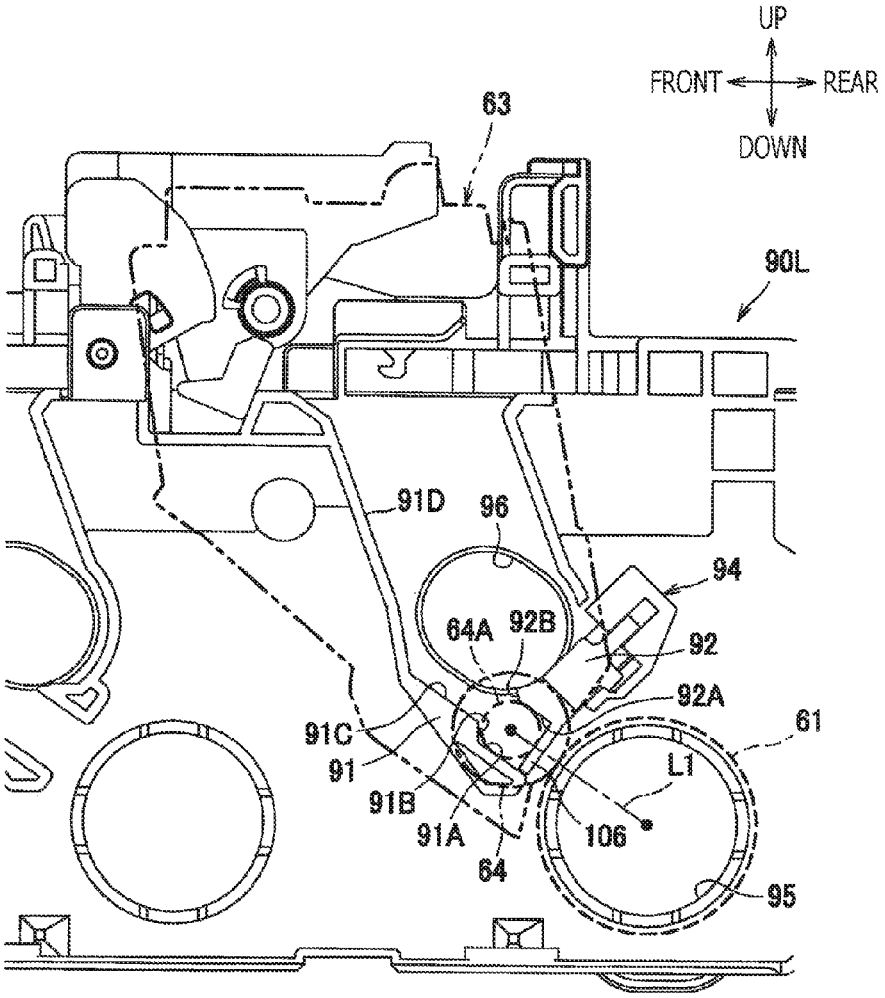
FIG. 5 is a lateral view of a cartridge guide of the left-side lateral wall of the drum unit from the inner side according to the embodiment of the present disclosure.

As shown in FIG. 5, the first guide 91 is formed to protrude inward from the inner face of the left-side lateral wall 90L and to extend longitudinally and diagonally lower-rearward from an upper edge of the left-side lateral wall 90L. The first guide 91 is fixed to the supporting member 90. The first guide 91 includes a first guiding surface 91A, a first inclined surface 91B, a third guiding surface 91C, and a fourth guiding surface 91D, which are arranged in the cited order, from a downstream side toward an upstream side along the attaching direction.

The first guiding surface 91A confronts a circumferential surface of the collar 64A when the developer roller 64 in the developer cartridge 63 is located in a contact position, in which the developer cartridge 63 contacts the photosensitive drum 61. In other words, the first guiding surface 91A confronts the collar 64A along an orthogonal direction being orthogonal to the axial direction of the rotation axis 64B of the developer roller 64. In the present embodiment, a state where the developer cartridge 63 is attached to the supporting member 90 may mean that the developer roller 64 is in contact with the photosensitive drum 61. Meanwhile, when the developer roller 64 is moved to contact or to be separated from the photosensitive drum 61, it may be preferable that the developer roller 64 is moved orthogonally to the surface of the photosensitive drum 61. Therefore, in order to move the developer roller 64 orthogonally to the surface of the photosensitive drum 61, the first guiding surface 91A longitudinally extends substantially in parallel with a line L1, which connects a rotation center of the collar 64A with a rotation center of the photosensitive drum 61.

Figure 6:
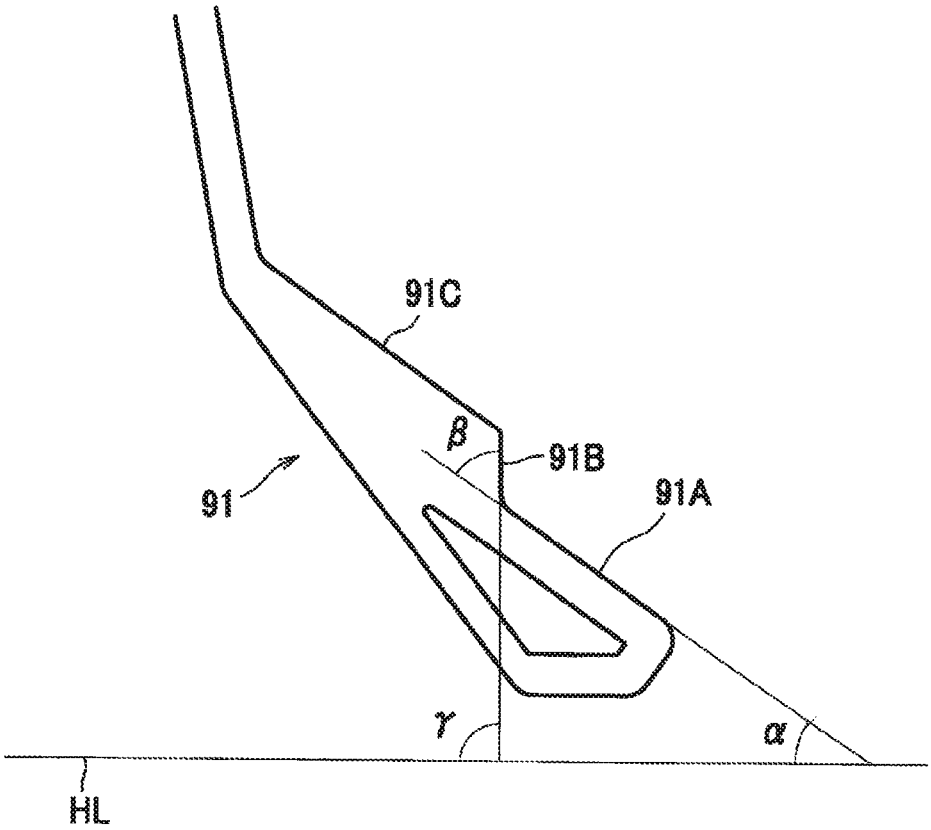
FIG. 6 is an enlarged partial view of a first guide in the laser printer according to the embodiment of the present disclosure.

As shown in FIG. 6, the first guiding surface 91A inclines with respect to a horizontal plane HL at an angle α. For example, the first guiding surface 91A may incline with respect to the horizontal plane HL at an angle in a range between 15 and 45 degrees. In the present embodiment, specifically, the angle of the first guiding surface 91A with respect to the horizontal plane HL may be 35 degrees.

The first inclined surface 91B includes an inclined surface arranged at a position upstream from the first guiding surface 91A with regard to the attaching direction. In other words, the first inclined surface 91B is located farther from the photosensitive drum 61 than the first guiding surface 91A. The first inclined surface 91B includes, as shown in FIG. 7C, one end E1, which is continuous from the first guiding surface 91A, and the other end E2, which is located farther from the photosensitive drum 61 than the one end E1. The first inclined surface 91B inclines with respect to the first guiding surface 91A at an angle β to arise toward the second guide 92. Specifically, the first inclined surface 91B inclines with respect to the first guiding surface 91A, as the first inclined surface 91B extends to be farther from the first guiding surface 91A, to arise to near the second guide 92 so that the other end E2 is closer to the second guide 92 than the one end E1 along a direction of a line L2, which will be described below. The first inclined surface 91B inclines with respect to the first guiding surface 91A at an angle in a range between, for example, 30 and 60 degrees. More specifically, the first inclined surface 91B may incline with respect to the first guiding surface 91A at 55 degrees so that the other end E2 may be closer to the second guide 92 than the one end E1.

While the developer roller 64 may be located in a separate position, in which the developer roller 64 is separated from the photosensitive drum 61, in order to prevent interference between the laser beam B1 emitted from the exposure device 5 at the photosensitive drum 61 and the developer cartridge 63, it may be preferable that the first inclined surface 91B extends substantially or approximately in parallel with the laser beam B1. With this arrangement, the developer roller 64 at the separate position may be separated from the photosensitive drum 61 for a substantial amount without interrupting the laser beam B1. Therefore, it may be preferable that an angle α of the inclination of the first inclined surface 91B with respect to the horizontal plane HL is larger than or equal to an angle of the laser beam B1 with respect to the horizontal plane. In other words, it may be preferable that the angle α of the inclination is between the direction of the beams B1 and the vertical direction. For example, the angle α of the inclination of the first inclined surface 91B with respect to the horizontal plane HL may be in a range between 80 and 90 degrees. In the present embodiment, the inclination may be the right angle, i.e., 90 degrees, with respect to the horizontal plane HL.

The third guiding surface 91C is continuous from an upstream end, i.e., the other end E2, of the first inclined surface 91B with regard to the attaching direction, and inclines with respect to the first inclined surface 91B. The third guiding surface 91C may extend substantially in parallel with the first guiding surface 91A. The third guiding surface 91C extends continuously from the other end E2 of the first inclined surface 91B.

As shown in FIG. 5, the fourth guiding surface 91D is continuous from an upstream end of the third guiding surface 91C with regard to the attaching direction and extends, with inflection at some degrees, to a position in vicinity to the upper edge of the left-side lateral wall 90L.

The second guide 92 is arranged to confront the first guide 91 along the orthogonal direction, which is orthogonal to the axial direction of the rotation axis of the developer roller 64, to guide the collar 64A. The second guide 92 is urged toward the first guide 91 and is movable between a closer position, in which the second guide 92 is closer to the first guide 91, and a farther position, in which the second guide 92 is separated farther from the first guide 91. The farther position may be regarded as a first position, and the closer position may be regarded as a second position. The second guide 92 is formed independently from the left-side lateral wall 90L. Meanwhile, the left-side lateral wall 90L has a restrictive part 94, to which the second guide 92 may be attached, to restrict the second guide 92 from moving. The left-side lateral wall 90L includes a drum-drive input hole 95, through which a driving force to drive the photosensitive drum 61 is input, at a lower-rearward position with respect to the second guide 92, and a driveinput hole 96, through which a driving force to drive the developer roller 64, at an upper-frontward position with respect to the second guide 92. The drive input hole 96 is formed at a position to coincide with the coupling 65B of the developer cartridge 63 in the widthwise direction. In this regard, when the developer cartridge 63 is attached to the supporting member 90, the coupling 65B of the developer cartridge 63 is arranged at a position opposite from the photosensitive drum 61 across the collar 64A in a view along the axial direction of the developer roller 64. The left-side lateral wall 90L may be formed in, for example, resin by injection molding.

Figure 4B:
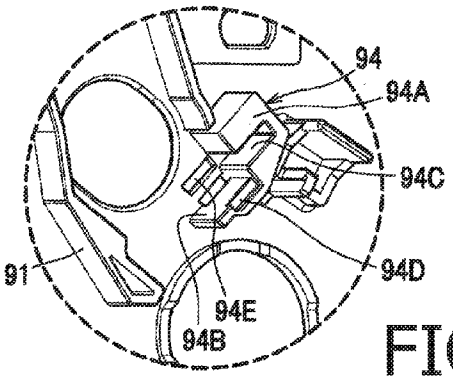
FIG. 4B is an enlarged view of a second-guide restrictive part on the left-side lateral wall of the drum unit according to the embodiment of the present disclosure.

As shown in FIG. 4B, the restrictive part 94 includes a first projection 94A, which projects inward, e.g., rightward, from the inner face of the left-side lateral wall 90L, and a second projection 94B, which projects lower-frontward from a lower end of the first projection 94A. The first projection 94A is formed to have a first recessed portion 94C, which extends in a movable direction of the second guide 92, i.e., the direction along which the second guide 92 may move to be closer to or farther from the first guide 91, to restrict the second guide 92 from moving along the first guiding surface 91A. The second projection 94B is formed to have a second recessed portion 94D, which extends along the movable direction of the second guide 92 to restrict a movable range of the second guide 92. The second recessed portion 94D is formed at rightward and leftward sides of the second projection 94B. Further, the left-side lateral wall 90L is formed to have a third recess 94E, which extends along the movable direction of the second guide 92, at a lower-frontward position with respect to the first recessed portion 94C.

As shown in FIGS. 7A-7B, the second guide 92 includes a main part 100, a contact part 106 extending downward from the main part 100, and a spring retainer 101 formed at an upper position with respect to the main part 100.

As shown in FIG. 7C, the main part 100 in the second guide 92 includes a second guiding surface 92A and a second inclined surface 92B. The second guiding surface 92A is arranged to extend in parallel with the first guiding surface 91A. The second inclined surface 92B extends from an upstream end of the second guiding surface 92A with regard to the attaching direction and inclines so that an upstream part thereof with regard to the attaching direction is farther from the first guiding surface 91 than a downstream part. The second inclined surface 92B is located to be farther than the second guiding surface 92A from the photosensitive drum 61. The second inclined surface 92B includes one end E3, which is continuous from the second guiding surface 92A, and an other end E4, which is located farther than the one end E3 from the photosensitive drum 61 along the direction of the line L2 described below. Specifically, the second inclined surface 92B inclines with respect to the second guiding surface 92A so that the other end E4 recedes farther than the one end E3 from the first guide 91. More specifically, the other end E4 may be farther than the one end E3 from the first inclined surface 91B in the first guide 91 to incline with respect to the second guiding surface 92A at an angle in a range between, for example, 30 and 60 degrees.

The second guiding surface 92A is, in the state where the developer cartridge 63 is attached to the supporting member 90, arranged to confront a circumferential surface of the collar 64A along the orthogonal direction being orthogonal to the axial direction of the rotation axis 64B of the developer roller 64, and extends in parallel with the first guiding surface 91A. A distance D1 between an upstream end, i.e., the one end E3, of the second guiding surface 92A with regard to the attaching direction and an upstream end, i.e., the other end E2, of the first inclined surface 91B with regard to the attaching direction, in the state where the developer cartridge 63 is attached to the supporting member 90, is smaller than a diameter of the collar 64A. In this regard, in order to allow the collar 64A to enter the position between the first guiding surface 91A and the second guiding surface 92A easily when the developer cartridge 63 is being attached to the supporting member 90, the second inclined surface 92B is formed to incline so that an entrance to the position between the first guiding surface 91A and the second guiding surface 92A may be widened.

The contact part 106 extends orthogonally from an end of the second guiding surface 92A closer to the photosensitive drum 61 toward the first guide 91. Therefore, the contact part 106 protrudes from the second guiding surface 92A of the second guide 92 toward the first guide 91 in a direction orthogonal to the second guiding surface 92A. The contact part 106 may contact the first guide 91 at a tip end thereof so that the second guide 92 may be located in a correct position with respect to the first guiding surface 91A of the first guide 91. Therefore, the contact part 106 may be regarded as a positioning part. The second guide 92 may be a relatively small part, and the contact part 106 is a protrusive portion in the relatively small part. However, the second guide 92 is formed independently from the left-side lateral wall 90L, and the contact part 106 may be formed easily and accurately to protrude for a correct amount. Therefore, the distance between the first guiding surface 91A and the second guiding surface 92A may be reserved correctly and constantly by arranging the contact part 106 to contact the first guiding surface 91A. The tip end of the contact part 106 may be, as shown in FIGS. 7C-7D, formed to have a rectangular surface so that the tip end of the contact part 106 and the first guiding surface 91A may be in surficial contact.

The spring retainer 101 includes an upper wall 101A, a lower wall 101B, a rightward wall 101C, and a leftward wall 101D, which are arranged to enclose a compressive spring 108 being an example of an urging member from four directions.

The upper wall 101A includes a first coil retainer 102, which protrudes downward toward the lower wall 101B, and the lower wall 101B includes a second coil retainer 103, which protrudes upward toward the upper wall 101A. The compressive spring 108 may include a coil spring, of which an upper end and lower end are retained by the first coil retainer 102 and the second coil retainer 103, respectively. The compressive spring 108 may be compressed to be attached to the spring retainer 101 through an opening between the rightward wall 101C and the leftward wall 101D.

A dimension of the upper wall 101A, an upper part of the rightward wall 101C, and an upper part of the leftward wall 101D is smaller than a diameter of the compressive spring 108. Thereby, the spring retainer 101 forms a first protrusive portion 104 that protrudes upward in an upper portion thereof. The first protrusive portion 104 is, as shown in FIG. 7C, engageable with the first recessed portion 94C in the restrictive part 94. With this engagement, the second guide 92 may be restricted from moving in the movable direction of the collar 64A, i.e., leftward or rightward in FIG. 7C. Meanwhile, due to the smaller dimension of the first protrusive portion 104 in the spring retainer 101 being smaller than the diameter of the compressive spring 108, an upper part of the compressive spring 108 may be exposed from the spring retainer 101, and the exposed part may contact a lower surface of the first projection 94A of the restrictive part 94. Thereby, with the upper end of the compressive spring 108 being supported by the restrictive part 94, the second guide 92 may be urged by the compressive spring 108 against the first guide 91. Thus, the compressive spring 108 may urge the second guide 92 toward the first guide 91.

The rightward wall 101C includes a second protrusive portion 105, which protrudes rearward of the spring retainer 101 from a central area in the rightward wall 101C. The second protrusive portion 105 is engageable with the second recessed portion 94D. With this engagement, when the second guide 92 slides to move vertically with respect to the restrictive part 94, an upper end and a lower end of the second protrusive portion 105 may contact an upper end and a lower end of the second recessed portion 94D, respectively, so that the movable range for the second guide 92 may be restricted.

The leftward wall 101D includes a third protrusion 107, which protrudes leftward from a central area in the leftward wall 101D. The third protrusion 107 is engageable with a third recess 94E in the left-side lateral wall 90L.

The compressive spring 108 is located in a position P3 ( FIG. 7C), which is closer than a line L2 to the photosensitive drum 61. The line L2 connects a position P1, at which the first guide 91 contacts the collar 64A of the developer roller 64, with a center P2 of the collar 64A. In other words, the compressive spring 108 is located on a rightward side in FIG. 7C with respect to the line L2. With this arrangement, the compressive spring 108 may be prevented from interfering with the input member that engages with the coupling 65B.

As shown in FIG. 8A, the right-side lateral wall 90R is substantially symmetrical to the left-side lateral wall 90L with exceptions that the drum-drive input hole 95 and the drive input hole 96 are not formed in the right-side lateral wall 90R.

The supporting member 90 in the drum unit 6 includes a presser device for each one of the developer rollers 64. Each presser device may urge the developer roller 64 toward the corresponding one of the photosensitive drums 61 and includes a presser member 121 and a torsion spring 121A. The torsion spring 121A may urge the presser member 121, for example, counterclockwise in FIGS. 8A-8C.

The presser member 121 is swingably supported by the supporting member 90 to swing about a swing axis 122. The presser member 121 contacts the boss 120 in the developer cartridge 63 to press the boss 120 from above both when the developer roller 64 is located in the contact position and in the separate position. When the developer roller 64 is located in the contact position and in the separate position, the developer roller 64 is urged by an urging force from the presser member 121 toward the photosensitive drum 61.

Meanwhile, the laser printer 1 includes a separator device 131, which may move the developer roller 64 between the contact position, in which the developer roller 64 contacts the photosensitive drum 61, and the separate position, in which the developer roller 64 is separated from the photosensitive drum 61. The separator device 131 may move one or more of the four developer rollers 64, which correspond to four colors of black, yellow, magenta, and cyan, to be separated from the corresponding photosensitive drum(s) 61. For example, in case of a monochrome printing operation, solely one of the developer roller 64 corresponding to black may be placed to contact the photosensitive drum 61, and the other three (3) photosensitive drums 61 corresponding to yellow, magenta, and cyan may be moved to be separated from the developer rollers 64. For another example, when the laser printer 1 is starting up before a printing operation, all of the four developer rollers 64 may be separated from the photosensitive drums 61.

The separator device 131 includes a linear motion cam 126, a pinion gear 127, and four (4) levers 123, which are attached to the body casing 2.

The linear motion cam 126 is arranged to longitudinally extend in the front-rear direction. The linear motion cam 126 includes four (4) cam parts 126A, each having a slant face 126B for each of the developer cartridges 63 and a rack gear 126C meshed with the pinion gear 127. The linear motion cam 126 is slidably movable in the front-rear direction by a guide, which is not shown.

The linear motion cam 126 includes four (4) cam parts 126A, each of which corresponds to one of the developer cartridges 63. Positions and lengths of the cam parts 126A in the front-rear direction may be designed depending on combinations of the developer rollers 64 to be separated.

The pinion gear 127 is rotatable by a driving force from a driving source, which is not shown, to move the linear motion cam 126 in the front-rear direction through the rack gear 126C. Each slant face 126B is a surface facing lower-rearward and inclines to be higher toward the rear.

The levers 123 are arranged on each widthwise side of the developer cartridge 63. Each lever 123 is supported by either the rightward or leftward lateral wall 90L, 90R to be swingable about a lever rotation shaft 124. The lever 123 includes a contact portion 123A that protrudes upward at a rearward position on an upper edge thereof. The contact portion 123A is arranged to confront the slant face 126B along the front-rear direction and may be pressed by the slant face 126B as the linear motion cam 126 slidably moves in the front-rear direction. Thus, the lever 123 may move to swing. Further, each lever 123 includes a separator member 125, which protrudes inward in the widthwise direction. The separator member 125 includes a first contact surface 125A and a second contact surface 125B that extends in a direction to intersect with the first contact surface 125A. For example, the first contact surface 125A and the second contact surface 125B may form a shape of an L in a side view along the widthwise direction. The first contact surface 125A may extend to point downward to be farther from the lever rotation shaft 124, and the second contact surface 125B may extend frontward from a lower end of the first contact surface 125A. The separator member 125 is integral with the lever 123; therefore, the separator member 125 may swing about the lever rotation shaft 124 along with the swing movement of the lever 123. The separator member 125 may move the developer roller 64 from the contact position toward the separate position against pressure from the presser member 121. In other words, specifically, the separator member 125 may move the developer roller 64 between the contact position, in which the developer roller 64 contacts the photosensitive drum 61, and the separate position, in which the developer roller 64 is separated from the photosensitive drum 61.

The separator member 125 is, in the state where the developer cartridge 63 is attached to the supporting member 90, at least partly located at a lower position with respect to the boss 120. For example, the second contact surface 125B may be separated for a small amount from the boss 120 at a position straight below the boss 120, and the first contact surface 125A may be at a frontward position with respect to the boss 120 to be separated from the boss 120.

Bellow will be described behaviors of the separator device 131 and behaviors of the developer cartridge 63 to be attached to or detached from the supporting member 90 in the laser printer 1 described above.

As shown in FIG. 8A, in the state where the developer cartridge 63 is attached to the supporting member 90, that is, when the developer roller 64 is located in the contact position, the slant face 126B is separated from the contact portion 123A of the lever 123. The second guide 92 is at the closer position, at which the tip end of the contact part 106 is in contact with the first guiding surface 91A of the first guide 91. In this arrangement, the collar 64A is at the position between the first guiding surface 91A of the first guide 91 and the second guiding surface 92A of the second guide 92; thereby, the position of the photosensitive drum 61 is restricted from varying. Meanwhile, as mentioned above, the distance between the first guiding surface 91A and the second guiding surface 92A is defined by the contact part 106, which may be formed with accuracy, displacement of the collar 64A from the position between the first guiding surface 91A and the second guiding surface 92A may be limited to be substantially small. Therefore, even when rotation of the developer roller 64 causes vibration of various kinds, the position of the collar 64A may be maintained stable, and the contact pressure between the developer roller 64 and the photosensitive drum 61 may be maintained steady so that an image may be formed with evenly applied toner preferably.

When the linear motion cam 126 moves rearward from the position shown in FIG. 8A, the slant face 126B of the linear motion cam 126 contacts the contact portion 123A in the lever 123 and presses the contact portion 123A downward. Thereby, the lever 123 swings counterclockwise.

Further, as shown in FIG. 8B, the separator member 125 swings counterclockwise about the lever rotation shaft 124 to move upward and contact the boss 120 at the second contact surface 125B from below to press the boss 120 upward. As the linear motion cam 126 moves further rearward, the slant face 126B moves the contact portion 123A further downward so that the lever 123 and the separator member 125 swing further counterclockwise. Accordingly, the first contact surface 125A approaches the boss 120 from the front to contact the boss 120. Thereby, the boss 120 is surrounded by the first contact surface 125A, the second contact surface 125B, and the presser member 121 from the three directions. Thus, the boss 120 may be held stably by the separator member 125 while the developer cartridge 63 is moved.

As the separator member 125 pushes the boss 120 upward to uplift the developer cartridge 63, the collar 64A may slide on the first guiding surface 91A to contact the first inclined surface 91B.

As shown in FIG. 8C, as the linear motion cam 126 moves further rearward, the contact portion 123A in the lever 123 is pushed downward below the slant face 126B at a lower side of the cam part 126A. Meanwhile, the developer roller 64 is at the separate position, which is substantially separated from the photosensitive drum 61. As the developer roller 64 moves to the separate position, the collar 64A contacting the first inclined surface 91B may climb vertically upward along the first inclined surface 91B. Thereafter, when the developer roller 64 is located in the separate position, the collar 64A is on a corner between the first inclined surface 91B and the second guiding surface 91C, with an upper part of the collar 64A being in contact with a corner between the first guiding surface 92A and the second inclined surface 92B. In this regard, when the developer roller 64 climbs upward, the collar 64A may uplift the second guide 92 against the urging force of the compressive spring 108.

A movable distance for the collar 64A being guided along the first guiding surface 91A in a direction from the center of the photosensitive drum 61 toward the center of the rotation axis 64B of the developer roller 64 may be, for example, in a range between 0.1 mm and 3 mm, and preferably, between 0.2 mm and 1 mm More preferably, the movable distance may be in a range between 0.3 mm and 0.5 mm. The shorter the movable distance is, the shorter a distance between adjoining developer cartridges 63 may be reduced to be, and the smaller the entire volume of the laser printer 1 may be. Meanwhile, with the minimum values provided in the ranges for the movable distance, when the developer roller 64 is moved at least for the minimum value of movable distance, the pressure between the developer roller 64 and the photosensitive drum 61 may be reduced to some extent, or the developer roller 64 may be substantially separated from the photosensitive drum 61. Therefore, friction between the developer roller 64 and the photosensitive drum 61 when the collar 64A moves along the first inclined surface 91B may be reduced or moderated.

When the developer roller 64 is moved from the separate position to the contact position, the behaviors described above are reversed. That is, the linear motion cam 126 may be moved frontward from the position shown in FIG. 8C, the contact portion 123A in the lever 123 may contact the slant face 126B, and the lever 123 may swing clockwise. Thereby, the separator member 125 may swing clockwise, the boss 120 being supported by the separator member 125 from below may move downward, and the entire developer cartridge 63 may descend. The collar 34A may move downward along the first inclined surface 91B and, as shown in FIG. 8B, contact the first guiding surface 91A. The linear motion cam 126 may further be moved frontward, the lever 123 may swing clockwise, and the developer roller 64 may be placed at the contact position, as shown in FIG. 8A, in which the developer roller 64 contacts the photosensitive drum 61.

Next, below will be described attaching and detaching behaviors of the developer cartridge 63 to the supporting member 90. When the developer cartridge 63 is to be attached to the supporting member 90, as shown in FIG. 9A, the collar 64A of the developer roller 64 descends along the first guide 91 and contacts the third guiding surface 91C and the second inclined surface 92B to move the second guide 92 upward. Thereby, as shown in FIG. 9B, the second guide 92 is placed at the separate position, and the distance between the first guide 91 and the second guide 92 is enlarged so that the collar 64A may be accommodated in the position between the first guiding surface 91A and the second guiding surface 92A. The second guide 92 may be urged downward by the compressive spring 108, and the contact part 106 may return to the position to contact the first guiding surface 91A.

When the developer cartridge 63 is to be detached from the supporting member 90, the collar 64A may ascend to contact the second guiding surface 92A and push the second guide 92 upward. Thereby, the distance between the first guide 91 and the second guide 92 may be enlarged. Further, the collar 64A may exit the position between the first guide 91 and the second guide 92 in a reverse sequence of the behaviors described above.

Below will be described benefits achievable by the configuration of the drum unit 6 described above.

When the developer roller 64 is moved by the separator device 131 toward the separate position, the collar 64A may contact the first inclined surface 91B to be guided by the first inclined surface 91B. Therefore, the developer cartridge 63 may move for the small distance in the direction from the center of the photosensitive drum 61 toward the center of the rotation axis 64B of the developer roller 64 and thereafter vertically along the first inclined surface 91B. The developer cartridge 63 moving vertically may perform the separating action without interfering with the other parts, including the adjoining developer cartridges 63, or the beams B1. Thus, interference between the developer cartridge 63 and the other parts and/or the items during the separating action may be prevented, and the image forming apparatus may be downsized.

Further, the second guide 92 has the second guiding surface 92A, which is arranged in parallel with the first guiding surface 91A of the first guide 91. Therefore, the collar 64A may be guided in the direction from the center of the photosensitive drum 61 toward the center of the rotation axis 64B of the developer roller 64 at the initial phase in the separating action. Thereby, friction between the developer roller 64 and the photosensitive drum 61 may be moderated.

Further, the second guide 92 has the second inclined surface 92B, which extends from the upstream end of the second guiding surface 92A with regard to the attaching direction and inclines so that the upstream part thereof with regard to the attaching direction is farther from the first guiding surface 91A than the downstream part. With this form of the second inclined surface 92B, the developer cartridge 63 may be attached to or detached from the supporting member 90 smoothly.

The second guide 92 is a part formed separately from the supporting member 90 and is relatively small compared to the supporting member 90. Therefore, a form and dimensions of the contact part 106 may be accurately achieved and easily managed. With the accurately formed contact part 106, when the developer cartridge 63 is attached to the supporting member 90, the second guide 92 at the closer position may contact the first guide 91 by the contact part 106; therefore, the position of the second guide 92 may be accurately maintained. Accordingly, accuracy in the distance between the first guide 91 and the second guide 92 may improve. Therefore, the distance between the first guiding surface 91A and the second guiding surface 92A may be defined correctly, and the positions of the developer roller 64 and the collar 64A may be correctly maintained. Thus, the position of the collar 64A may be maintained stable, and the contact pressure between the developer roller 64 and the photosensitive drum 61 may be stabilized so that an image may be formed preferably.

The second guide 92 is movable between the closer position, in which the second guide 92 confronts the first guide 91 to guide the collar 64A at the position closer to the first guide 91, and the farther position, in which the second guide 92 is farther from the first guide 91. Therefore, the collar 64A may be placed at the position between the first guiding surface 91A and the second guiding surface 92A without reserving a larger distance between the first guiding surface 91A and the second guiding surface 92A at the closer position with respect to the diameter of the collar 64A. In other words, with at least one of the first guide 91 and the second guide 92 being movable, a margin for the distance between the first guide 91 and the second guide 92 at the closer position may be reduced, and positional accuracy of the developer roller 64 may be improved.

Meanwhile, the presser member 121 may press the boss 120 in the developer cartridge 63 when the developer roller 64 is located both in the contact position and in the separate position. Therefore, the positions of the developer roller 64 in the contact position and the separate position may be stabilized.

When the developer roller 64 is in the separate position, the first contact surface 125A and the second contact surface 125B may both contact the boss 120. Thereby, the boss 120 may be surrounded by the first contact surface 125A, the second contact surface 125B, and the presser member 121 from the three directions. Thus, the boss 120 may be held stably by the separator member 125 while the developer cartridge 63 is moved.

Although an example of carrying out the present disclosure have been described, those skilled in the art may recognize that there are numerous variations and permutations of the image forming apparatus that fall within the spirit and scope of the invention as set forth in the appended claims. It may be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters.

Below will be described modified examples of the drum unit 6 according to the embodiment of the present disclosure. In the following examples, items or structures which are the same as or similar to the items or the structure described in the previous embodiment will be referred to by the same reference signs, and description of those will be omitted.

For example, while the developer roller 64 is located at the separate position by the separator device 131, the collar 64A may not necessarily climb on the corner between the first inclined surface 91B and the second guiding surface 91C, but, as shown in FIG. 10, the collar 64A may be maintained to contact the first inclined surface 91B. With the collar 64A at this position, the movable amount for the developer roller 64, e.g., rightward movement in FIG. 10, may be reduced compared to the arrangement, in which the collar 64A climbs on the corner between the first inclined surface 91B and the second guiding surface 91C. Therefore, the developer cartridge 63 may be prevented from interfering with the adjoining developer cartridges 63 or the beams B1 even more effectively.

For another example, with the inclination of the first inclined surface 91B with respect to the horizontal plane HL, when the developer roller 64 is located at the separate position by the separator device 131, the collar 64A may be maintained in contact with the first inclined surface 91B. Therefore, when the developer cartridge 63 is moved from the separate position toward the contact position, and separation between the developer roller 64 and the photosensitive drum 61 is terminated, the developer cartridge 63 may be moved by a weight of its own and by the presser member 121 smoothly.

For another example, the collar 64A fitted with the rotation shaft 64B of the developer roller 64 may not necessarily be the only protrusion that protrudes along the axial direction of the developer roller 64, but the protrusion that protrudes along the axial direction of the developer roller 64 may include the rotation shaft 64B of the developer roller 64, a bearing (not shown) of the developer roller 64, and further, any other protrusion that may protrude outward from the cartridge case 65 that supports the developer roller 64.

For another example, the compressive spring 108 may be replaced with, for example, a torsion spring.

What is claimed is:

1. An image forming apparatus, comprising:

a photosensitive drum;

a developer cartridge comprising a developer roller and a protrusion that protrudes in an axial direction of the developer roller;

a casing, to which the developer cartridge is attachable;

a separator member configured to move the developer cartridge between a contact position, in which the developer roller contacts the photosensitive drum, and a separate position, in which the developer roller is separated from the photosensitive drum; and a first guide arranged to confront the protrusion of the developer cartridge along an orthogonal direction orthogonal to the axial direction in a state where the developer cartridge is attached to the casing, the first guide comprising a first guiding surface and a first inclined surface, the first guiding surface extending in parallel with a line that connects a center of a rotation axis of the developer roller with a center of a rotation axis of the photosensitive drum in a state where the developer roller is located in the contact position, the first inclined surface being located farther from the photosensitive drum than the first guiding surface and being continuous with the first guiding surface, the first inclined surface being inclined with respect to the first guiding surface, wherein the protrusion of the developer cartridge contacts the first inclined surface when the separator member moves the developer cartridge toward the separate position.

2. The image forming apparatus according to claim 1, further comprising:

a second guide arranged to confront the first guide along the orthogonal direction to guide the protrusion of the developer cartridge, the second guide being movable between a first position and a second position being closer to the first guide than the first position, the second guide being urged toward the first guide to allow the second guide to move from the second position to the first position.

3. The image forming apparatus according to claim 2, wherein the second guide comprises a second guiding surface, the second guiding surface being arranged to confront the protrusion of the developer cartridge along the orthogonal direction and extending in parallel with the first guiding surface in the state where the developer roller is located in the contact position.

4. The image forming apparatus according to claim 3, wherein the second guide comprises a second inclined surface, the second inclined surface being located farther from the photosensitive drum than the first guiding surface, the second inclined surface comprising one end and an other end located farther from the photosensitive drum than the one end, the second inclined surface being inclined with respect to the second guiding surface with the other end thereof receding farther from the first guide than the one end thereof.

5. The image forming apparatus according to claim 4, wherein the second inclined surface is inclined with respect to the second guiding surface at an angle in a range between 30 degrees and 60 degrees.

6. The image forming apparatus according to claim 2, wherein the second guide comprises a contact part configured to be urged toward the first guide to contact the first guide.

7. The image forming apparatus according to claim 1, wherein the first inclined surface comprises one end and an other end located farther from the photosensitive drum than the one end;

wherein the first guide comprises a third guiding surface extending from the other end of the first inclined surface, the third guiding surface inclining with respect to the first inclined surface; and wherein the protrusion of the developer cartridge contacts the first inclined surface without contacting the third guiding surface in a state where the developer roller is located in the separate position.

8. The image forming apparatus according to claim 1, further comprising:

a presser member configured to urge the developer roller toward the photosensitive drum, wherein the developer cartridge comprises a boss configured to be pressed by the presser member;

wherein the presser member presses the boss in the state where the developer roller is located in the contact position and in a state where the developer roller is located in the separate position.

9. The image forming apparatus according to claim 8, wherein the separator member is configured to move the developer roller from the contact position toward the separate position against pressure from the presser member;

wherein the separator member comprises a first contact surface and a second contact surface extending in a direction to intersect with the first contact surface; and wherein the first contact surface and the second contact surface contact the boss in the state where the developer roller is located in the separate position.

10. The image forming apparatus according to claim 1, further comprising:

an exposure device configured to expose the photosensitive drum to light, wherein an angle of the first inclined surface with respect to a horizontal plane is larger than or equal to an angle of a beam emitted from the exposure device at the photosensitive drum with respect to the horizontal plane.

11. The image forming apparatus according to claim 10, wherein the first inclined surface is inclined with respect to the horizontal plane at an angle in a range between 80 degrees and 90 degrees.

12. The image forming apparatus according to claim 1, wherein the first inclined surface is inclined with respect to the first guiding surface at an angle in a range between 30 degrees and 60 degrees.

13. The image forming apparatus according to claim 1, wherein the first inclined surface is inclined with respect to a horizontal plane at an angle in a range between 15 degrees and 45 degrees.

* * * * *